US007337110B2

(12) United States Patent
Jasiuk

(10) Patent No.: US 7,337,110 B2
(45) Date of Patent: Feb. 26, 2008

(54) STRUCTURED VSELP CODEBOOK FOR LOW COMPLEXITY SEARCH

(75) Inventor: Mark A. Jasiuk, Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 1100 days.

(21) Appl. No.: 10/227,725

(22) Filed: Aug. 26, 2002

(65) Prior Publication Data

US 2004/0039567 A1 Feb. 26, 2004

(51) Int. Cl.
*G10L 19/12* (2006.01)

(52) U.S. Cl. ..... 704/222

(58) Field of Classification Search ..... 704/222
See application file for complete search history.

(56) References Cited

U.S. PATENT DOCUMENTS 4,817,157 A 3/1989 Gerson
5,241,650 A 8/1993 Gerson et al.
5,253,269 A 10/1993 Gerson et al.
5,265,219 A 11/1993 Gerson et al.
5,359,696 A 10/1994 Gerson et al.
5,434,947 A 7/1995 Gerson et al.
5,485,581 A * 1/1996 Miyano et al. ..... 704/223
5,490,230 A 2/1996 Gerson et al.
5,528,723 A 6/1996 Gerson et al.
5,570,453 A 10/1996 Gerson et al.
5,642,368 A 6/1997 Gerson et al.
5,657,418 A 8/1997 Gerson et al.
5,675,702 A 10/1997 Gerson et al.
5,692,101 A 11/1997 Gerson et al.
5,768,613 A * 6/1998 Asghar ..... 712/35
5,826,224 A 10/1998 Gerson et al.
5,936,605 A * 8/1999 Munjal ..... 345/102
6,073,092 A * 6/2000 Kwon ..... 704/219
6,269,332 B1 * 7/2001 Choo et al. ..... 704/233
6,397,178 B1 * 5/2002 Benyassine ..... 704/230

* cited by examiner

*Primary Examiner*—David Hudspeth
*Assistant Examiner*—Jakieda Jackson

(57) ABSTRACT

A codebook excited linear prediction coding system providing improved digital speech coding for high quality speech at low bit rates with side-by-side codebooks for segments of the modeled input signal to reduce the complexity of the codebook search. A linear predictive filter responsive to an input signal desired to be modeled is used for identifying a basis vector from a first codebook over predetermined intervals as a subset of the input signal. A long term predictor and a vector quantizer provide synthetic excitation of modeled waveform signal components corresponding to the input signal desired to be modeled from side-by-side codebooks by providing codevectors with concatenated signals identified from the basis vector over the predetermined intervals with respect to the side-by-side codebooks. Once a codevector is identified, the codebook at the next segment is searched and a concatenation of codevectors is provided by selecting up to but not including the current segment. The codevector is treated as an additional basis vector for the codebook search at the current segment. It is possible to significantly reduce the complexity of the VSELP codebook search by precomputing and storing the terms for the code search that do not change from segment to segment. Using these techniques, the complexity of searching a 45 bit VSELP codebook (N=40, M=45, M'=9, J=5) was found to be approximately equivalent to searching a traditionally structured 10 bit VSELP codebook (N=40, M=10, J=1). A concatenation of codevectors or carry-along basis vectors are formed as a concatenation of VSELP codevectors selected up to but not including the current segment.

24 Claims, 8 Drawing Sheets

STRUCTURED VSELP CODEBOOK FOR LOW COMPLEXITY SEARCH

BACKGROUND OF THE INVENTION

1. Field of the Invention

The present invention generally relates to digital speech coding for efficient modeling, quantization, and error minimization of waveform signal components and speech prediction residual signals at low bit rates, and more particularly to improved methods for coding the excitation information for code-excited linear predictive speech coders.

2. Description of the Related Art

In low rate coding applications such as digital speech, linear predictive coding (LPC) or similar techniques are typically used to model the spectra of short term speech signals. Systems employing LPC techniques provide prediction residual signals for corrections to the short term model characteristics.

A speech coding technique known as code-excited linear prediction (CELP) produces high quality synthesized speech at low bit rates, i.e., 4.8 to 9.6 kilobits-per-second (kbps). This class of speech coding is also known as vector-excited linear prediction or stochastic coding, which is used in numerous speech communications and speech synthesis applications. CELP is also particularly applicable to digital speech encryption and digital radiotelephone communication systems wherein speech quality, data rate, size, and cost are significant issues.

The LPC system of a CELP speech coder typically employs long term ("pitch") and short term ("formant") predictors that model the characteristics of the input speech signal and are incorporated in a set of time-varying linear filters. An excitation signal for the filters is chosen from a codebook of stored innovation sequences, or codevectors. For each frame of speech, the speech coder applies each individual codevector to the filters to generate a reconstructed speech signal, and compares the original input speech signal to the reconstructed signal to create an error signal. The error signal is then weighted by passing it through a weighting filter having a response based on human auditory perception. The optimum excitation signal is determined by selecting the codevector that produces the weighted error signal with the minimum energy for the current frame. For each block of speech, a set of linear predictive coding (LPC) parameters are produced in accordance with prior art techniques. The short term predictor parameters STP, long term predictor parameters LTP, and excitation gain factor may be sent over the channel for use by the speech synthesizer. See, e.g., "Predictive Coding of Speech at Low Bit Rates," IEEE Trans. Commun., Vol. COM-30, pp. 600-14, April 1982, by B. S. Atal, for representative methods of generating these parameters.

The stored excitation codevectors generally include independent random white Gaussian sequences. One codevector from the codebook is used to represent each block of N excitation samples. Each stored codevector is represented by a codeword, i.e., the address of the codevector memory location. It is this codeword that is subsequently sent over a communications channel to the speech synthesizer to reconstruct the speech frame at the receiver. See, M. R. Schroeder and B. S. Atal, "Code-Excited Linear Prediction (CELP): High-Quality Speech at Very Low Bit Rates", Proceedings of the EEEE International Conference on Acoustics, Speech and Signal Processing (ICASSP), Vol. 3, pp. 937-40, March 1985, for a detailed explanation of CELP.

The difficulty of the CELP speech coding technique lies in the extremely high computational complexity of performing an exhaustive search of all the excitation codevectors in the codebook. Moreover, the memory allocation requirement to store the codebook of independent random vectors is also exorbitant. For the above example, a 640 kilobit read-only-memory (ROM) would be required to store all 1024 codevectors, each having 40 samples, each sample represented by a 16-bit word. Thus, substantial computational efforts are required to search the entire codebook, e.g., 1024 vectors, for the best fit—an unreasonable task for real-time implementation with today's digital signal processing technology.

An alternative for reducing the computational complexity of this codevector search process is to implement the search calculations in a transform domain. Refer to I. M. Trancoso and B. S. Atal, "Efficient Procedures for Finding the Optimum Innovation in Stochastic Coders", Proc. ICASSP, Vol. 4, pp. 2375-8, April 1986, as an example of such a procedure. Using this approach, discrete Fourier transforms (DFT's) or other transforms may be used to express the filter response in the transform domain such that the filter computations are reduced to a single multiply-accumulate operation (MAC) operation per sample per codevector.

Another alternative for reducing the computational complexity is to structure the excitation codebook such that the codevectors are no longer independent of each other. In this manner, the filtered version of a codevector can be computed from the filtered version of the previous codevector, again using only a single filter computation MAC per sample. Examples of these types of codebooks are given in the article entitled "Speech Coding Using Efficient Pseudo-Stochastic Block Codes", Proc. ICASSP, Vol. 3, pp. 1354-7, April 1987, by D. Lin. Nevertheless, 24,000,000 MACs per second would still be required to do the search. Moreover, the ROM size is based on $2^M$×n bits/word, where M is the number of bits in the codeword such that the codebook contains $2^M$ codevectors. Therefore, the memory requirements still increase exponentially with the number of bits used to encode the frame of excitation information. For example, the ROM requirements increase to 64 kilobits when using 12 bit codewords.

Another example of a structured excitation codebook is a Vector Sum Excited Prediction (VSELP) codebook, disclosed in U.S. Pat. No. 4,817,157 issued Mar. 28, 1989 to Ira Gerson for "Digital Speech Coder Having Improved Vector Excitation Source" assigned to applicant's assignee, and hereby incorporated by reference. According to one implementation of a VSELP excitation codebook, all $2^M$ excitation codevectors may be generated as a linear combination of M basis vectors, where codeword I specifies the polarity of each of the M basis vectors in the linear combination. The entire codebook can be searched using only M+3 multiply-accumulate operations per codevector evaluation. Other advantages of a VSELP codebook are efficient codebook storage (only the M basis vectors need to be stored, instead of $2^M$ codevectors), resilience to channel errors, and an ability to optimize the VSELP basis vectors utilizing an off line codebook training procedure.

Since the complexity of performing an exhaustive search of an excitation codebook is a function of the type of excitation codebook used and the value of M, one approach to managing the complexity of searching an excitation codebook is to limit the value of M. From coding efficiency perspective, however, it may be advantageous to make M large, because that would allow the speech coder designer the freedom to utilize a longer excitation codevector length and simultaneously lower the rate at which the gain factor for scaling the selected codevector needs to be encoded.

The Sparse Algebraic Codebook (SAC) of Jean-Pierre Adoul, University of Sherbrooke, offers one formulation of an excitation codebook that has the ability to be defined by a large number of bits (M). The Algebraic Codebook itself need not be stored. Instead a compact set of rules defines, for a given codeword, how a codevector is to be constructed, via a placement of unity amplitude pulses (+/−1) within the initially zero valued codevector. This set of rules is stored both at the encoder and at the decoder. Search complexity is typically kept managable by not searching the codebook exhaustively. While allowing reasonable search complexity, low codebook storage space, and utilization of long codevector lengths, the requirement that the excitation codevector be constructed from unity amplitude pulses, prevents use of an off line codebook training procedure from being applied to optimize the relative amplitudes of the samples in the excitation codebook.

A need, therefore, exists to provide an improved speech coding technique that addresses both the problems of extremely high computational complexity for codebook searching given large values of M, as well as the vast memory requirements for storing the excitation codevectors with solutions for making long codevector length codebook practical.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying Tables and drawings, in the several figures of which like-referenced numerals identify like elements, and in which:

DETAILED DESCRIPTION OF THE PREFERRED EMBODIMENT

Figure 1:
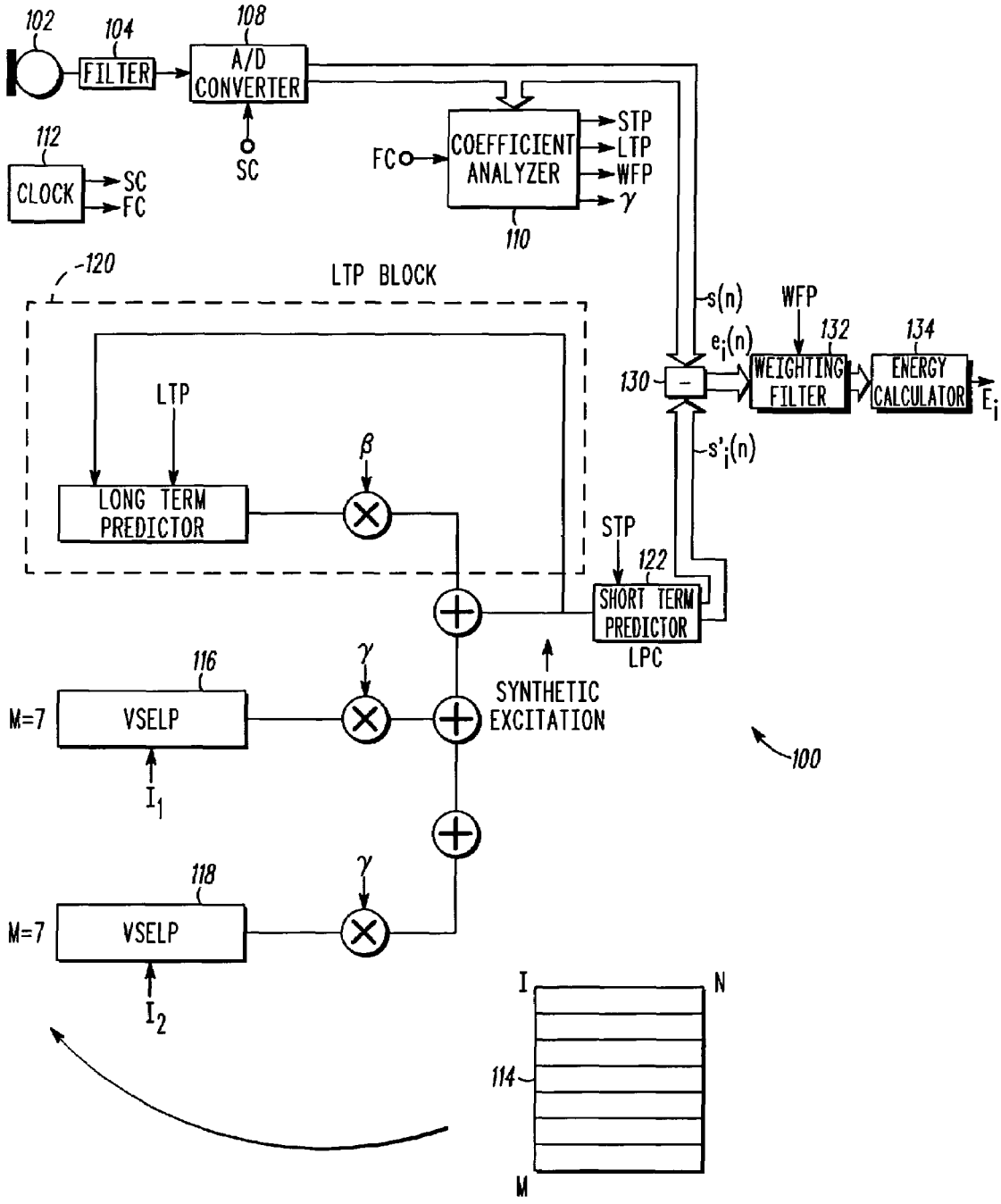
FIG. 1 is a general block diagram of a code-excited linear predictive speech coder utilizing the vector sum excitation signal generation technique in accordance with the present invention.

A class of analysis-by-synthesis speech coders includes a family of speech coders known as Code-Excited Linear Prediction (CELP) coders. In a CELP coder the excitation codebook is searched to identify an excitation codevector, which when processed by a long term predictor (LTP) filter and the short term predictor (STP) filter, also called a synthesis filter, will best match the input speech vector. Typically this is done by computing the Mean Squared Error (MSE) between the input speech vector and a filtered version of each vector stored in the excitation codebook. I, the index of the codevector from the excitation codebook that minimized the MSE at the encoder, is then transmitted to the decoder. The decoder uses the transmitted index, which it received from the encoder, to extract the excitation codevector from the excitation codebook, which is identical to the excitation codebook used by the encoder. The extracted excitation codevector is then typically applied to the LTP filter and the STP filter to reconstruct the synthetic speech. Typically the gain (or scale factor) for codevector I is quantized, as are the parameters defining the LTP filter and the STP filter. The indices of those quantized parameters are transmitted from the encoder to the decoder, in addition to the index I, and are used by the decoder to reconstruct the synthetic speech.

In a typical CELP speech coder, the speech coder parameters are partitioned into distinct parameter classes, where each parameter class is updated at a unique rate. For example, the speech coder parameters may be partitioned into frame parameters and subframe parameters, where a frame is defined as a time interval corresponding to some number of input samples and spans at least one subframe. Define N to be the subframe length in samples. In this example, the STP filter parameters are updated at a frame rate, while excitation codevector index I, the quantized gain associated with it, and the LTP filter parameters are updated at subframe rate, which is a multiple of the frame rate.

A number of techniques have been developed and proposed to reduce the storage required by and the complexity of searching an M bit excitation codebook. These techniques typically impose a structure on the codebook and the resulting codebooks are thus referred to as structured codebooks. VSELP codebook is one type of a structured codebook. The present invention provides an improved codebook searching technique having reduced computation complexity for "code-excited" or "vector-excited" excitation sequences in applications where the speech coder uses vector quantization for the excitation. An improved digital speech coding technique produces high quality speech at low bit rates. An efficient excitation vector generating technique further reduces memory and digital signal processing technology requirements. By using single codewords to represent a sequence, or vector, of excitation samples, data rates of less than one bit per sample are possible for coding the excitation sequence.

The result is an improved speech coding technique that addresses both the problems of extremely high computational complexity for codebook searching given large values of M, as well as the vast memory requirements for storing the excitation codevectors with solutions for making long codevector length codebook practical.

Briefly summarized, the present invention in its most efficient embodiment relates to a codebook excited linear prediction coding system providing improved digital speech coding for high quality speech at low bit rates with side-by-side codebooks for segments of the modeled input signal to reduce the complexity of the codebook search. A linear predictive filter responsive to an input signal desired to be modeled is used to select a codevector from a first codebook over predetermined intervals as a subset of the input signal. A long term predictor and an excitation vector quantizer may provide synthetic excitation of modeled waveform signal components corresponding to the input signal desired to be modeled from side-by-side codebooks by providing codevectors with concatenated signals identified from the basis vector over the predetermined intervals with respect to the side-by-side codebooks. Once a codevector is identified, the codebook at the next segment is searched and a concatenation of codevectors is provided by selecting up to but not including the current segment. The concatenated codevector thus constructed is treated as an additional basis vector for the codebook search at the current segment. A concatenated codevector is formed as a concatenation of VSELP codevectors selected up to but not including the current segment to form a carry-along basis vector, used as an additional basis vector at the current segment.

An excitation codebook in a CELP-type speech coder, partly defines the computational complexity of the speech coder in which it is embedded. If M bits are used to specify an excitation codebook codeword, and the codebook is searched exhaustively, $2^M$ codevectors are evaluated. To limit computational complexity, typically M<12 bits. If M, the budget of bits/subframe for coding the excitation is large, several smaller codebooks may be used in side-by-side configuration (as defined later) or in a multi-stage configuration to reduce search complexity, i.e., $M=M_1+M_2+\ldots M_K$. In each of those two cases, each codebook typically will require encoding of a gain factor associated with it. An example of multi-stage codebook configuration, where M=14, $M_1$=7, and $M_2$=7, is given in the paper "Vector sum excited linear prediction (VSELP) speech coding at 8 kbps", Proc. ICASSP, Vol 1, pp. 461-464, April 1990, by I. A. Gerson and M. A. Jasiuk. An example of a speech coder using codebooks in a side-by-side configuration is given in a document TIA/EIA/IS-733.

Use of an excitation codebook specified by a large number of bits (or equivalently containing a large number of codevectors) offers an advantage that a longer codevector length may be utilized. The relatively long codevector length lowers the rate at which the gain scale factor (applied to the codevector) needs to be transmitted (thus increasing coding efficiency). However, the drawback of using such a codebook is that typically the search complexity is very high, which may make use of such a codebook impractical.

The present invention presents a solution for efficiently searching an excitation codebook specified by a large number of bits, i.e., where M is a large number, and where the excitation codebook is based on a VSELP codebook. The VSELP codebook (Gerson, U.S. Pat. No. 4,817,157) forms the basis for this invention.

Assume that M bits are available to encode an excitation codevector that is to be multiplied by a single gain factor. Further assume that the M bits are distributed among J VSELP codebooks, where J>1, and $M=M_1+\ldots+M_J$, with $M_1$ being the number of bits allocated to the $1^{st}$ VSELP codebook and $M_J$ the number of bits allocated to the J-th VSELP codebook. Accordingly there are provided at least J codebooks with M bits distributed between/among them. Define the excitation codevector to be a linear superposition of the J VSELP codevectors, each selected from its corresponding VSELP codebook. The codebook search strategy is as follows: The first VSELP codebook is searched to select a VSELP codevector. The VSELP codevector so selected is treated as an additional VSELP basis vector for searching the 2-nd VSELP codebook. Thus although the second VSELP codebook is defined by $M_2$ bits, for the purpose of the codebook search it may be viewed as an $M_2$+1 bit codebook. Note that to further reduce the computational complexity, the polarity of the additional basis vector may be fixed (i.e., not allowed to change) during the search of the $2^{nd}$ VSELP codebook. In that case, the additional basis vector (termed the carry-along basis vector) would still participate in defining the optimal value of the gain factor for each VSELP codevector being evaluated from the $2^{nd}$ VSELP codebook. If J>2, the codevector selected from the $2^{nd}$ VSELP codebook is constructed, and used to update the additional basis vector for searching the $3^{rd}$ VSELP codebook. The additional basis vector for the search of the j-th VSELP codebook, where $2 \leqq j \leqq J$, is defined to be a linear superposition of the VSELP codevectors selected from VSELP codebooks 1 through j−1. If the polarity of the carry-along basis vector is allowed to change during the search of the j-th VSELP codebook, the codewords for VSELP codebooks 1 through j−1, need to be updated to reflect the corresponding polarity change in VSELP codevectors up to j−1 stage. It is clear that this approach can be extended to arbitrarily large values of J.

In another aspect of the invention, it is possible to further reduce the complexity of codebook search by imposing additional structure on the codevector definition. Assume that M bits are available to code an excitation codevector that is to be multiplied by a single gain factor. Further assume that J identical VSELP codebooks are arranged side-by-side, and that VSELP codevectors selected from each of the J VSELP codebooks are to be multiplied by a single gain scale factor. Accordingly there are provided at least J codebooks and M bits, with each of the J identical codebooks defined by M' bits, where M'=M/J. Use of identical VSELP codebooks in a side-by-side configuration makes it possible to further reduce computational complexity, as will be later explained. The codebook search strategy is as follows: The first of the J codebooks is searched for the best codevector. Once that codevector is identified, the codebook at the next segment is searched, but now that codebook is defined by M'+1 basis vectors, instead of by M' basis vectors. Since the codevector (or a concatenation of codevectors) is selected up to but not including the current segment, the codevector is treated as an additional basis vector for the VSELP codebook search at the current segment. Note that in this case, where identical side-by-side codebooks are employed, the excitation codevector is formed as a concatenation of VSELP codevectors selected from the J VSELP codebooks. It can be equivalently (and more generally) stated that the excitation codevector is formed as a linear superposition of the J codevectors selected from their respective VSELP codebooks, where the J VSELP codebooks may be placed in a side-by-side configuration. Likewise the construction of the additional basis vector, can be characterized as being a linear superposition of the VSELP codevectors selected up to but not including the current segment, where the J VSELP codebooks are placed in a side-by-side configuration.

Referring now to FIG. 1, there is shown a general block diagram of code excited linear predictive speech coder 100 utilizing the excitation signal generation technique according to the VSELP technique. The known CELP techniques of digital speech coding employing vector excitation sources as discussed in U.S. Pat. No. 4,817,157 issued Mar. 28, 1989 to Gerson for "Digital Speech Coder Having Improved Vector Excitation Source" assigned to applicant's assignee are hereby incorporated by reference. The VSELP codebook, disclosed in that patent forms the building block for the present invention, and is now described for completeness.

An input signal to be analyzed is applied to speech coder 100 at microphone 102. The input signal, typically a speech signal, is then applied to filter 104. Filter 104 generally will exhibit bandpass filter characteristics. However, if the input signal is already band limited, filter 104 may comprise a direct wire connection.

The analog speech signal from filter 104 is then converted into a sequence of digital samples, and the amplitude of each sample is then represented by a digital code in analog-to-digital (A/D) converter 108, as known in the art. The sampling rate is determined by sampling clock, which represents an 8.0 kHz rate in the preferred embodiment. The sampling clock is generated along with the frame clock (FC) via clock 112. The filtered or band limited input signal s(n) from the A/D converter 108 and the frame clock 112 are provided to a coefficient analyzer block 110, which provides filter parameters used in the speech coder 100. The VSELP block 116 outputs a codevector based on the index parameter i, which is scaled and summed with the output of the long term predictor block, if used, to provide a synthetic excitation to a short term predictor (STP) 122 generating signal $s'_i(n)$, from which a difference error signal is generated at a subtractor 130. The error signal is passed through a weighting filter, block 132, whose output is squared and summed in block 134 to produce an energy $E_i$, representing the weighted Mean Square Error (MSE) corresponding to the use of codevector i. Resetting the filter memories of STP and W back to their original values, this process is repeated for all the codevectors in the VSELP codebook. This produces a series of error energies, $E_i$, with the value of i corresponding to the smallest value of E. I is then the codeword corresponding to the selected VSELP codevector.

Figure 2:
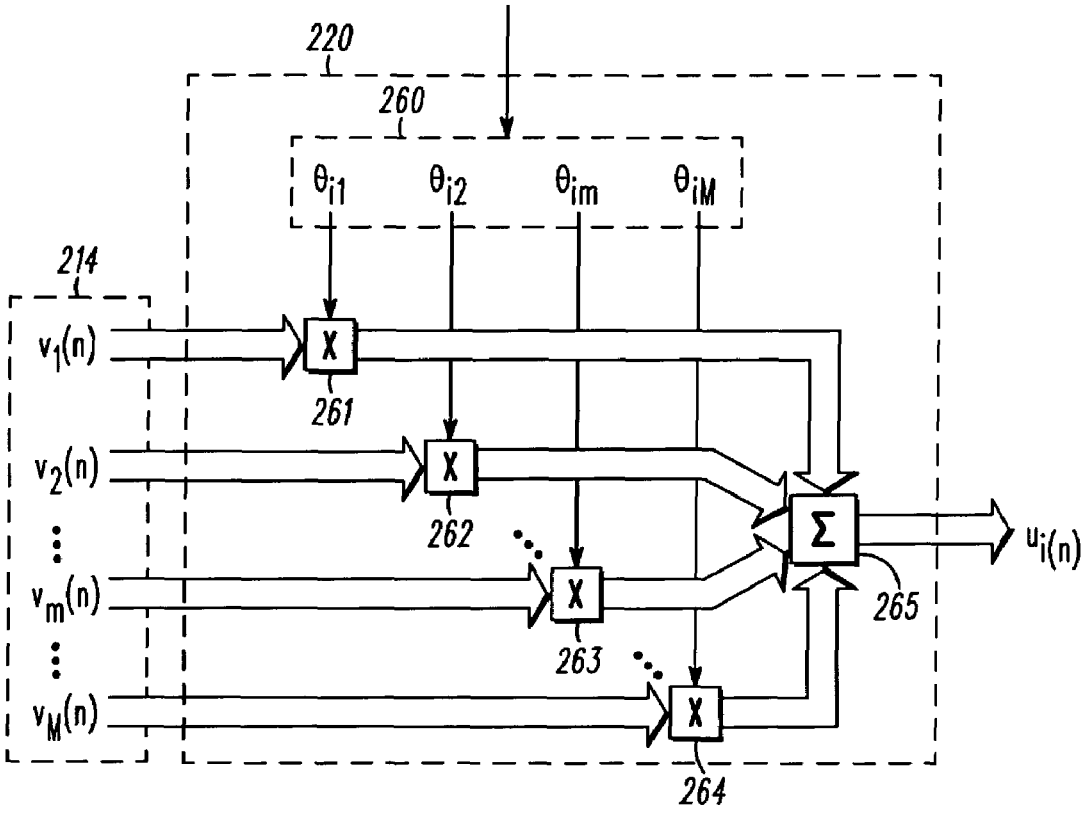
FIG. 2 is a detailed block diagram of the Vector Sum Excitation signal generator block of FIG. 1, illustrating the vector sum technique of the present invention.

FIG. 2, illustrating a representative hardware configuration for codebook generator 116, will now be used to describe the vector sum technique. Generator block 220 provides codebook generator, while memory 214 corresponds to codebook (CB) basis vector storage 114. Memory block 214 stores all of the M basis vectors $v_1(n)$ through $v_M(n)$, wherein $1 \leqq m \leqq M$, and wherein $1 \leqq n \leqq N$. All M basis vectors are applied to multipliers 261 through 264 of generator 220. The i-th excitation codeword is applied to converter 260. This excitation information is then converted into a plurality of interim data signals $\theta_{i1}$ through $\theta_{iM}$, wherein $1 \leqq m \leqq M$, by converter 260. In the preferred embodiment, the interim data signals are based on the value of the individual bits of the selector codeword i, such that each interim data signal $\theta_{im}$ represents the sign corresponding to the m-th bit of the i-th excitation codeword. For example, if bit one of excitation codeword i is 0, the $\theta_{i1}$ would be −1. Similarly, if the second bit of excitation codeword i is 1, then $\theta_{i2}$ would be +1. It is contemplated, however, that the interim data signals may alternatively be any other transformation from i to $\theta_{im}$, e.g., as determined by a ROM look-up table. Also note that the number of bits in the codeword do not have to be the same as the number of basis vectors. For example, codeword i could have 2M bits where each pair of bits defines 4 values for each $\theta^{im}$, i.e., 0, 1, 2, 3, or +1, −1, +2, −2, etc.

The interim data signals are also applied to multipliers 261 through 264. The multipliers are used to multiply the set of basis vectors $v_m(n)$ by the set of interim data signals $\theta_{im}$ to produce a set of interim vectors that are then summed together in summation network 265 to produce the single excitation codevector $u_i(n)$. Hence, the vector sum technique is described by the equation:

$$u_i(n) = \sum_{m=1}^{M} \theta_{im} v_m(n) \qquad \{1\}$$

where $u_i(n)$ is the n-th sample of the i-th excitation codevector, and where $1 \leqq n \leqq N$.

Figure 3A:
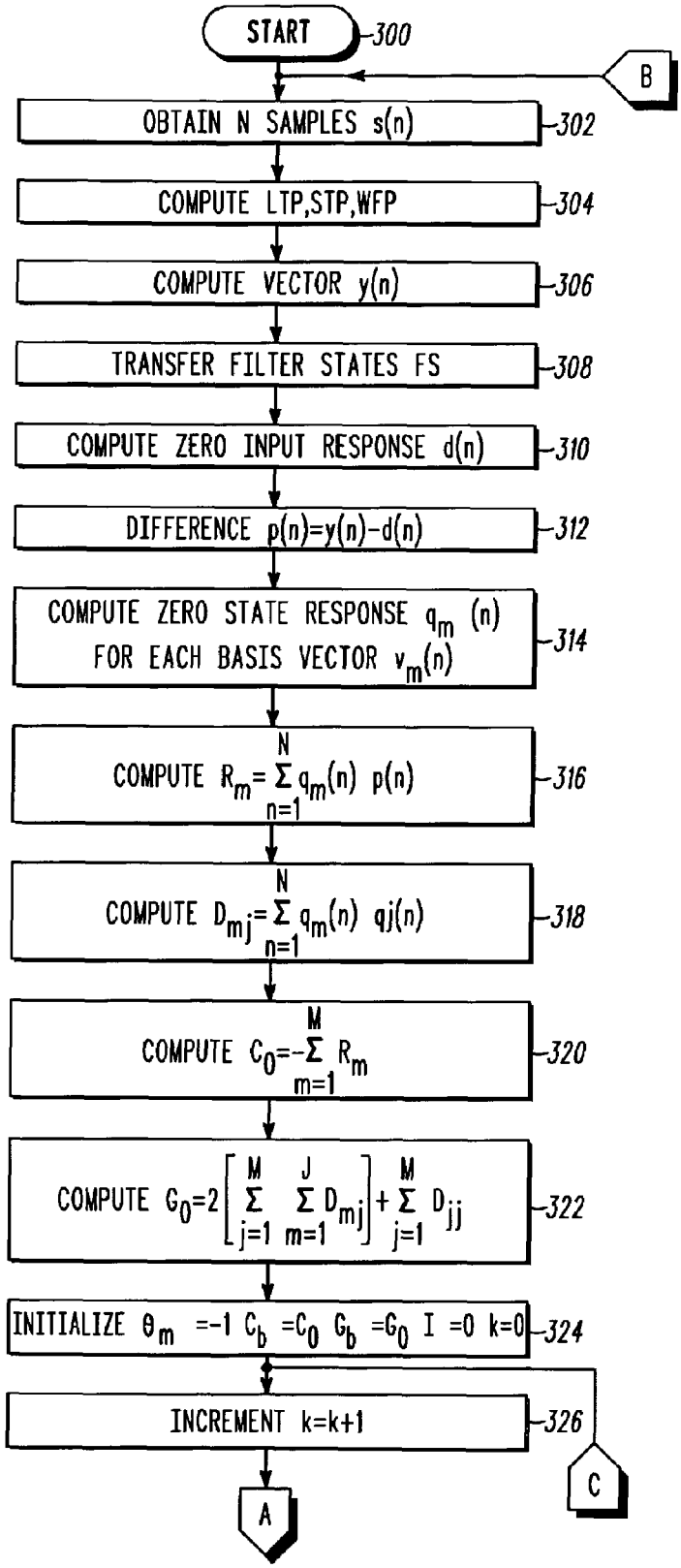
FIGS. 3A and 3B are detailed flowchart diagrams illustrating the sequence of operations performed by an embodiment of the speech coder of FIG. 1.
Figure 3B:
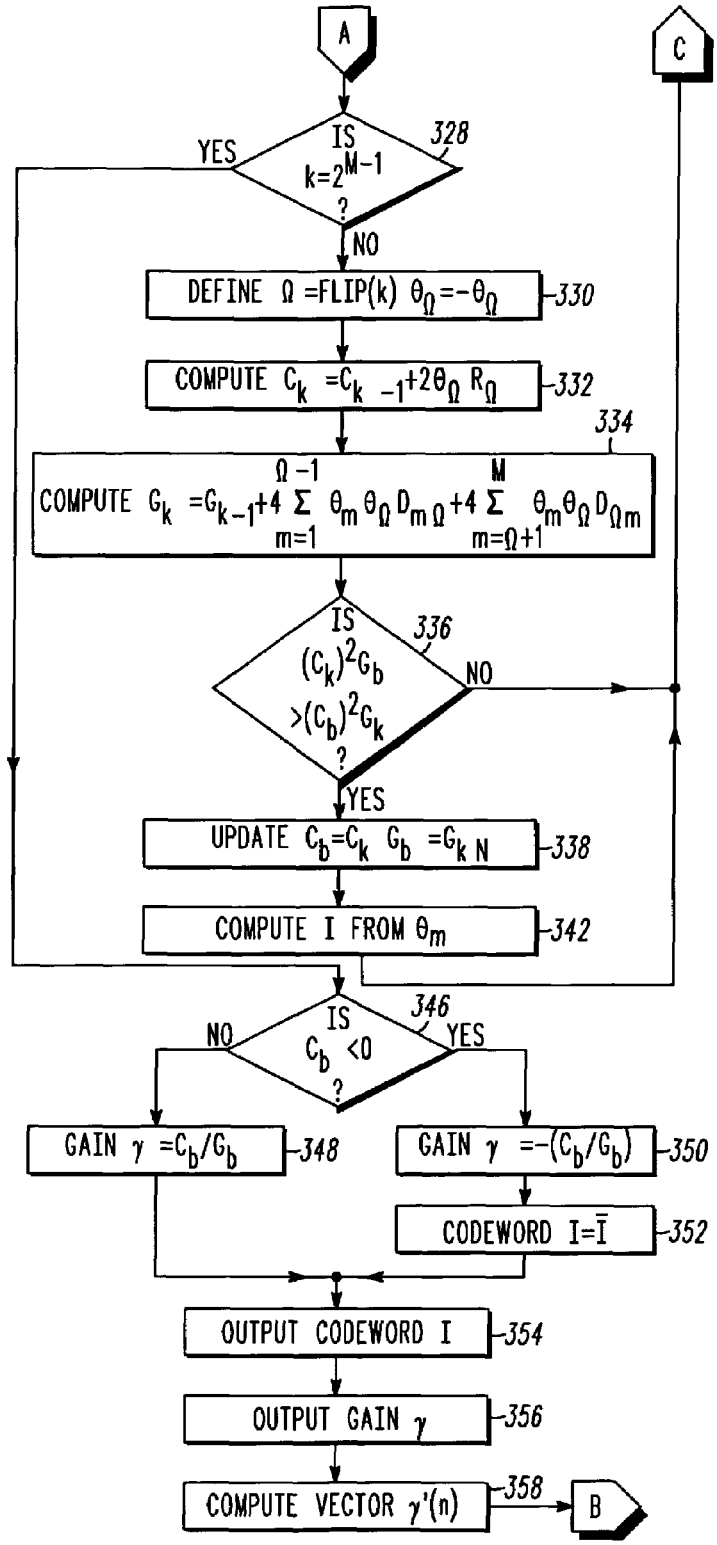

FIGS. 3A and 3B are detailed flow chart diagrams illustrating the sequence of operations performed by the speech coder 100 relative to the VSELP codebook search. In steps 310-312, the difference vector p(n) is calculated, which represents the difference between the weighted input speech vector y(n) and the zero input response vector d(n), described by equation {2}:

$$p(n) = y(n) - d(n). \qquad \{2\}$$

The difference vector p(n) is then used as the target vector in the codebook searching process to identify a codeword I for the VSELP codebook. For an exhaustive search of an M bit codebook this involves performing $2^M$ MSE calculations at a subframe to identify the index I of the codevector that minimizes the MSE. For a VSELP codebook it is sufficient to explicitly evaluate the MSE for $2^{M-1}$ codevectors, since for each codevector a VSELP codebook also implicitly contains its complement. $E_i$, the MSE corresponding to the i-th codevector, assuming that an optimal codevector gain $\gamma_i$ is used, is given by:

$$E_i = \sum_{n=1}^{N} [p(n) - \gamma_i p'_i(n)]^2,\ 0 \le i < 2^M \qquad \{3\}$$

and it can be shown that the optimal gain $\gamma_i$ is:

$$\gamma_i = \frac{C_i}{G_i},\ \text{where}\ C_i = \sum_{n=1}^{N} p(n) p'_i(n),\ \text{and}\ G_i = \sum_{n=1}^{N} p'_i(n) p'_i(n) \qquad \{4\}$$

$C_i$ is the correlation between p(n), the weighted vector to be approximated, and $p_i(n)$, the i-th filtered codevector. $G_i$ is the power in the i-th filtered codevector. P, the power in p(n), the input vector to be matched over the subframe, is defined to be:

$$P = \sum_{n=1}^{N} p^2(n) \qquad \{5\}$$

Given those definitions, $E_i$ may be equivalently defined as:

$$E_i = P - \frac{C_i^2}{G_i} \qquad \{6\}$$

From {6} it can be seen that since $P \geqq 0$ and $$\frac{C_i^2}{G_i} \ge 0,$$

minimizing $E_1$ involves identifying the index of the codevector for which the value of $$\frac{C_i^2}{G_i}$$

is maximized over all the codevectors in the codebook, or, equivalently, the codevector that maximizes:

$$\frac{C_i^2}{G_i}, \forall i. \quad \{7\}$$

In terms of achieving the goal of maximizing $[C_i]^2/G_i$ as shown in FIG. 3B, this term must be evaluated for each of the $2^M$ codebook vectors—not the M basis vectors. However, this parameter can be calculated for each codeword based on parameters associated with the M basis vectors rather than the $2^M$ codevectors. Hence, the zero state response vector $q_m(n)$ must be computed for each basis vector $v_m(n)$ in step 314.

In step 316, the first cross-correlator computes cross-correlation array $R_m$ according to the equation:

$$R_m = \sum_{n=1}^{N} q_m(n)p(n) \quad \{8\}$$

Array $R_m$ represents the cross-correlation between the m-th filtered basis vector $q_m(n)$ and p(n). Similarly, the second cross-correlator computes cross-correlation matrix $D_{mj}$ in step 318 according to the equation:

$$D_{mj} = \sum_{n=1}^{N} q_m(n)q_j(n) \quad \{9\}$$

where $1 \leqq m \leqq j \leqq M$. Matrix $D_{mj}$ represents the cross-correlation between pairs of individual filtered basis vectors. Note that $D_{mj}$ is a symmetric matrix. Therefore, approximately half of the terms need only be evaluated as shown by the limits of the subscripts.

The vector sum equation from above:

$$u_i(n) = \sum_{m=1}^{M} \theta_{im} v_m(n) \quad \{1\}$$

can be used to derive $f_i(n)$ as follows:

$$f_i(n) = \sum_{m=1}^{M} \theta_{im} q_m(n) \quad \{10\}$$

where $f_i(n)$ is the zero state response of the filters to excitation vector $u_i(n)$, and where $q_m(n)$ is the zero state response of the filters to basis vector $v_m(n)$ Equation {11}:

$$C_i(n) = \sum_{n=1}^{N} f_i(n)p(n) \quad \{11\}$$

can be rewritten using equation {10} as:

$$C_i = \sum_{m=1}^{M} \theta_{im} \sum_{n=1}^{N} q_m(n)p(n). \quad \{12\}$$

Using equation {8}, this can be simplified to:

$$C_i = \sum_{m=1}^{M} \theta_{im} R_m. \quad \{13\}$$

For the first codeword, where i=0, all bits are zero. Therefore, $\theta_{0m}$ for $1 \leqq m \leqq M$ equals −1 as previously discussed. The first correlation $C_0$, which is just $C_i$ from equation {12} where i=0, then becomes:

$$C_0 = -\sum_{m=1}^{M} R_m. \quad \{14\}$$

which is computed in step 320 of the flowchart.

Using $q_m(n)$ and equation {10}, the energy term $G_i$ may also be rewritten from equation {16}:

$$G_i = \sum_{n=1}^{N} [f_i(n)]^2 \quad \{16\}$$

into the following:

$$G_i = \sum_{n=1}^{N} \left[ \sum_{m=1}^{M} \theta_{im} q_m(n) \right]^2 \quad \{17\}$$

which may be expanded to be:

$$G_i = \sum_{j=1}^{M} \sum_{m=1}^{M} \theta_{im}\theta_{ij} \sum_{n=1}^{N} q_m(n)q_j(n). \quad \{18\}$$

Substituting by using equation {9} yields:

$$G_i = 2\sum_{j=1}^{M} \sum_{m=1}^{j} \theta_{im}\theta_{ij} D_{mj} + \sum_{j=1}^{M} D_{jj}. \quad \{19\}$$

By noting that a codeword and its complement, i.e., wherein all the codeword bits are inverted, both have the same value of $[C_i]^2/G_i$, both codevectors can be evaluated at the same time. The codeword computations are then halved. Thus, using equation {19} evaluated for i=0, the first energy term $G_0$ becomes:

$$G_0 = 2\sum_{j=1}^{M}\sum_{m=1}^{j} D_{mj} + \sum_{j=1}^{M} D_{jj} \quad \{20\}$$

which is computed in step 322. Hence, up to this step, we have computed the correlation term $C_0$ and the energy term $G_0$ for codeword zero.

Continuing with step 324, the parameters $\theta_{im}$ are initialized to −1 for $1 \leqq m \leqq M$. These $\theta_{im}$ parameters represent the M interim data signals that would be used to generate the current codevector as described by equation {1}. (The i subscript in $\theta_{im}$ was dropped in the figures for simplicity.) Next, the best correlation term $C_b$ is set equal to the pre-calculated correlation $C_0$, and the best energy term $G_b$ is set equal to the pre-calculated $G_0$. The codeword I, which represents the codeword for the best excitation vector $u_I(n)$ for the particular input speech frame s(n), is set equal to 0. A counter variable k is initialized to zero, and is then incremented in step 326.

In FIG. 3B, the counter k is tested in step 328 to see if all $2^M$ combinations of basis vectors have been tested. Note that the maximum value of k is $2^{M-1}$, since a codeword and its complement are evaluated at the same time as described above. If k is less than $2_{M-1}$, then step 330 proceeds to define a function "flip" wherein the variable 1 represents the location of the next bit to flip in codeword i. This function is performed since the present invention utilizes a Gray code to sequence through the codevectors changing only one bit at a time. Therefore, it can be assumed that each successive codeword differs from the previous codeword in only one bit position. In other words, if each successive codeword evaluated differs from the previous codeword by only one bit, which can be accomplished by using a binary Gray code approach, then only M add or subtract operations are needed to evaluate the correlation term and energy term. Step 330 also sets $\theta_l$ to $-\theta_l$ to reflect the change of bit 1 in the codeword.

Using this Gray code assumption, the new correlation term $C_k$ is computed in step 332 according to the equation:

$$C_k = C_{k-1} + 2\theta_1 R_1 \quad \{21\}$$

This was derived from equation {13} by substituting $-\theta_l$ for $\theta_l$.

Next, in step 334, the new energy term $G_k$ is computed according to the equation:

$$G_k = G_{k-1} + 4\sum_{m=1}^{l-1} \theta_m \theta_l D_{ml} + 4\sum_{m=l+1}^{M} \theta_m \theta_l D_{lm}, \quad \{22\}$$

which assumes that $D_{jk}$ is stored as a symmetric matrix with only values for $j \leqq k$ being stored. Equation {22} was derived from equation {19} in the same manner.

Once $G_k$ and $C_k$ have been computed, then $[C_k]^2/G_k$ must be compared to the previous best $[C_b]^2/G_b$. Since division is inherently slow, it is useful to reformulate the problem to avoid the division by replacing it by cross multiplication. Since all terms are positive, this equation is equivalent to comparing $[C_k]^2 \times G_b$ to $[C_b]^2 \times G_k$, as is done in step 336. If the first quantity is greater than the second quantity, then control proceeds to step 338, wherein the best correlation term $C_b$ and the best energy term $G_b$ are updated, respectively. Step 342 computes the excitation codeword I from the $\theta_m$ parameter by setting bit m of codeword I equal to 1 if $\theta_m$ is +1, and by setting bit m of codeword I equal to 0 if $\theta_m$ is −1, for all m bits $1 \leqq m \leqq M$. Control then returns to step 326 to test the next codeword, as would be done immediately if the first quantity was not greater than the second quantity.

Once all the pairs of complementary codewords have been tested and the codeword that maximizes the $[C_b]^2/G_b$ quantity has been found, control proceeds to step 346, which checks to see if the correlation term $C_b$ is less than zero. This is done to compensate for the fact that the codebook was searched by pairs of complementary codewords. If $C_b$ is less than zero, then the gain factor γ is set equal to $-[C_b/G_b]$ in step 350, and the codeword I is complemented in step 352. If $C_b$ is not negative, then the gain factor γ is just set equal to $C_b/G_b$ in step 348. This ensures that the gain factor γ is positive.

Next, the best codeword I is output in step 354, and the gain factor γ is output in step 356. Step 358 then proceeds to compute the reconstructed weighted speech vector y'(n) by using the best excitation codeword I. Codebook generator uses codeword I and the basis vectors $v_m(n)$ to generate excitation vector $u_I(n)$ according to equation {1 }. Codevector $u_I(n)$ is then scaled by the gain factor γ in gain block, and filtered by filter string #1 to generate y'(n). Filter string #1 is the weighted synthesis filter. Filter string #1 is used to update the filter states FS by transferring them to filter string #2 to compute the zero input response vector d(n) for the next frame. Filter string #2 uses the same filter coefficients as filter string #1. Accordingly, control returns to step 302 to input the next speech frame s(n).

In the search approach described in FIGS. 3A and 3B, the gain factor γ is computed at the same time as the codeword I is optimized. In this way, the optimal gain factor for each codeword can be found. The algorithm described above has been configured so as to reduce computational complexity.

Care must be taken when selecting M in a speech coder design because the number of codevector searches is a function of M. That is because given an M bit codebook, $2^M$ codevectors may be constructed, and $2^{M-1}$ codevector evaluations are done to identify the codevector that yields the lowest weighted MSE. This constrains the largest value of M to be typically less than 12 bits for a practical speech coder implementation. If a large number of bits is budgeted for an excitation codebook, the choice facing the speech coder designer is to partition those bits among several codebooks, arranged either in a multi-stage fashion, in a side-by-side configuration, or some combination of the two. Traditionally each codevector would have a gain associated with it. A methodology for structuring a VSELP codebook has been developed, which allows M to be a large number, while maintaining low codebook search complexity. This codebook structure retains the inherent advantages of the VSELP codebook, such as resilience to channel errors, low search complexity, and the ability to train the VSELP basis vectors to optimize the prediction gain due to the excitation codebook.

If M, the budget of bits/subframe for coding the excitation is large, computational complexity can be reduced by the use of J smaller codebooks used in side-by-side configuration. The smaller codebooks would be of size Mj ,where, $M=M_1+M_2+\ldots M_J$, and j=1, . . . ,J. This results in reduced number of code searches since:

$$2^M \geqq 2^{M_1} + 2^{M_2} + \ldots 2^{M_j} \quad \{23\}$$

In the above approach, although the computational complexity of searching the codebook is reduced, by distributing the M bits among J codebooks, the number of codevector gains that need to be coded is increased from 1 to J.

The VSELP codebook is defined by M basis vectors each spanning K samples, where K is typically equal to the subframe length N (FIG. 1). When the VSELP codebooks are arranged in side-by-side configuration within a subframe, K<N. The methodology is as follows: Assume that M bits are available to code a VSELP excitation vector that is to be multiplied by a single gain factor. Further assume that J identical VSELP codebooks are arranged side-by-side such that $M_1=M_2=\ldots=M_J$, and the codevectors output by each codebook are to be multiplied by a single gain scale factor. Since there are J codebooks and M bits, each of the J identical codebooks is defined by M' bits, where M'=M/J. This configuration of the codebook for J=4 is shown in Table 1.

TABLE 1

| K = N/4 samples | K = N/4 samples | K = N/4 samples | K = N/4 samples |
|---|---|---|---|
| Codebook 1 | Codebook 2 | Codebook 3 | Codebook 4 |
| Basis vector 1 | Basis vector 1 | Basis vector 1 | Basis vector 1 |
| Basis vector 2 | Basis vector 2 | Basis vector 2 | Basis vector 2 |
| Basis vector 3 | Basis vector 3 | Basis vector 3 | Basis vector 3 |
| Basis vector 4 | Basis vector 4 | Basis vector 4 | Basis vector 4 |
| Basis vector 5 | Basis vector 5 | Basis vector 5 | Basis vector 5 |
| . . . | | | |
| Basis vector M' | Basis vector M' | Basis vector M' | Basis vector M' |

Figure 4A:
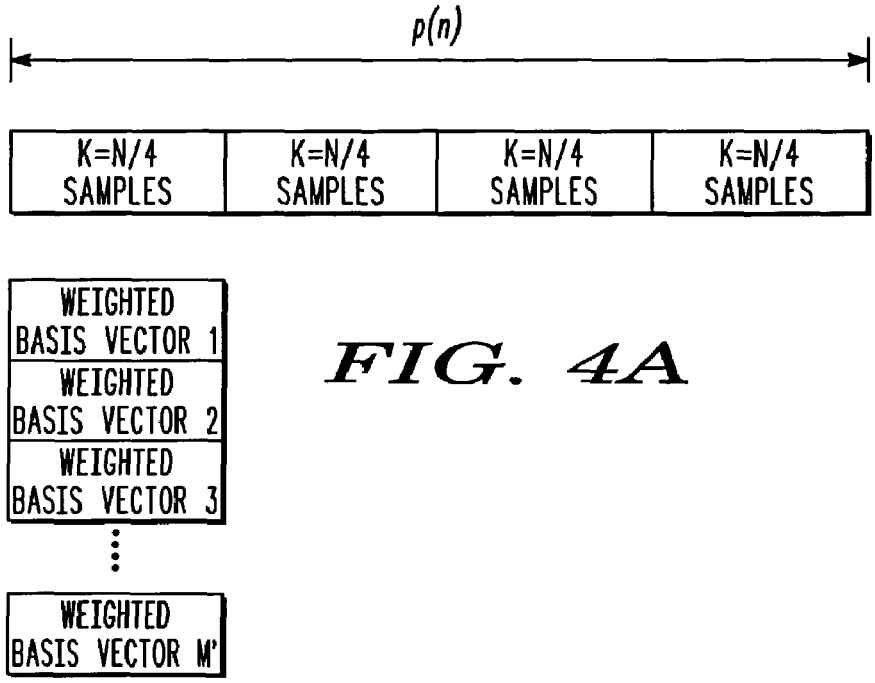
FIGS. 4A-4H are detailed diagrams, included to illustrate the sequence of operations for outputting codewords in progression as performed in accordance with the present invention as embodied in the speech coder of FIG. 1.

The first of the J codebooks is searched for the best codevector. The codebook search is done over the first K samples of the weighted target vector p(n) as shown in FIG. 4A. Once that codevector is identified, it is constructed and weighted (see FIG. 4B) to be used at the next segment as an additional weighted basis vector—(M'+$1^{th}$) basis vector—for searching the codebook at that segment (see FIG. 4C). Thus when the codebook at that ($2^{nd}$) segment is searched, it is defined by M'+1 basis vectors, instead of by M' basis vectors. That is because the codevector (or a concatenation of codevectors) selected up to but not including the current segment, is treated as an additional basis vector for the VSELP codebook search at the current segment. The codebook search at the j-th segment seeks to identify the VSELP codevector from the j-th codebook, which minimizes the weighted MSE over the first j*K samples of the subframe. If the side-by-side codebooks are identical, as described, it is possible to significantly reduce the complexity of the VSELP codebook search by precomputing and storing the terms for the code search that do not change from segment to segment. Thus the denominator terms (G's) for the VSELP codebook search may be precomputed and stored at the first of the J segments, and subsequently combined at each of the following segments with the recursively computed portion of the denominator term that is unique for a given segment (i.e., is a function of the additional basis vector) to yield the effective G for the codevector being evaluated up to and including the current segment, by invoking linear superposition.

The calculation of the correlation between the target signal for the codebook search and the additional weighted basis vector (being grown by concatenation and recursively applied convolution) may be recursively computed to further reduce computation. A version of the convolution function that assumes zero-state and a version of the convolution function that assumes zero-input, may be employed to eliminate the multiplications that involve deterministically located 0 valued samples. The convolution functions are needed to convolve the unweighted basis vectors with the impulse response of the perceptually weighted synthesis filter. Furthermore, the weighting of the M' basis vectors is done only over the segment length, which, if N is the subframe length and J is the number of segments, is K=N/J samples long, where K is the basis vector length for each of the M' basis vectors. The length of the additional (M'+$1^{th}$) weighted basis vector is j*K, where $2 \leqq j \leqq J$ and j is the index of the current segment.

Figure 4B:
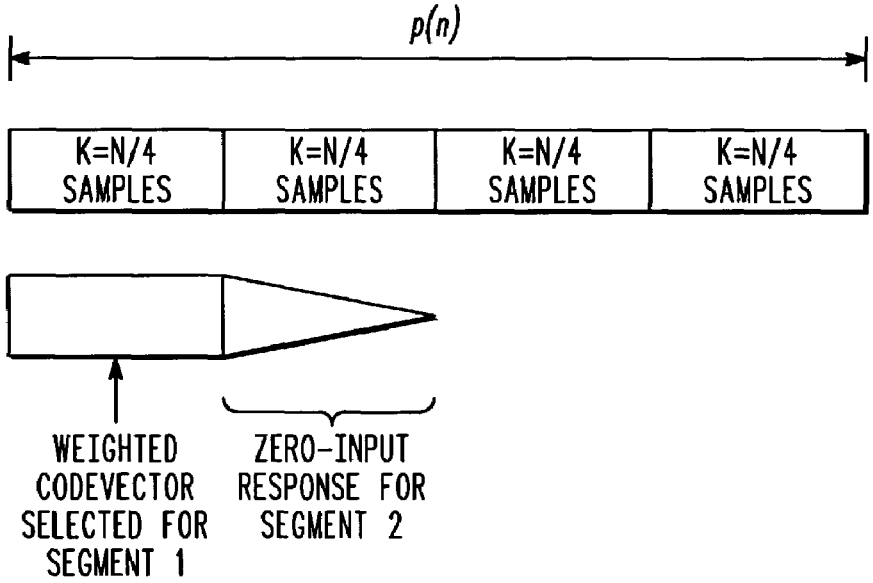
Figure 4C:
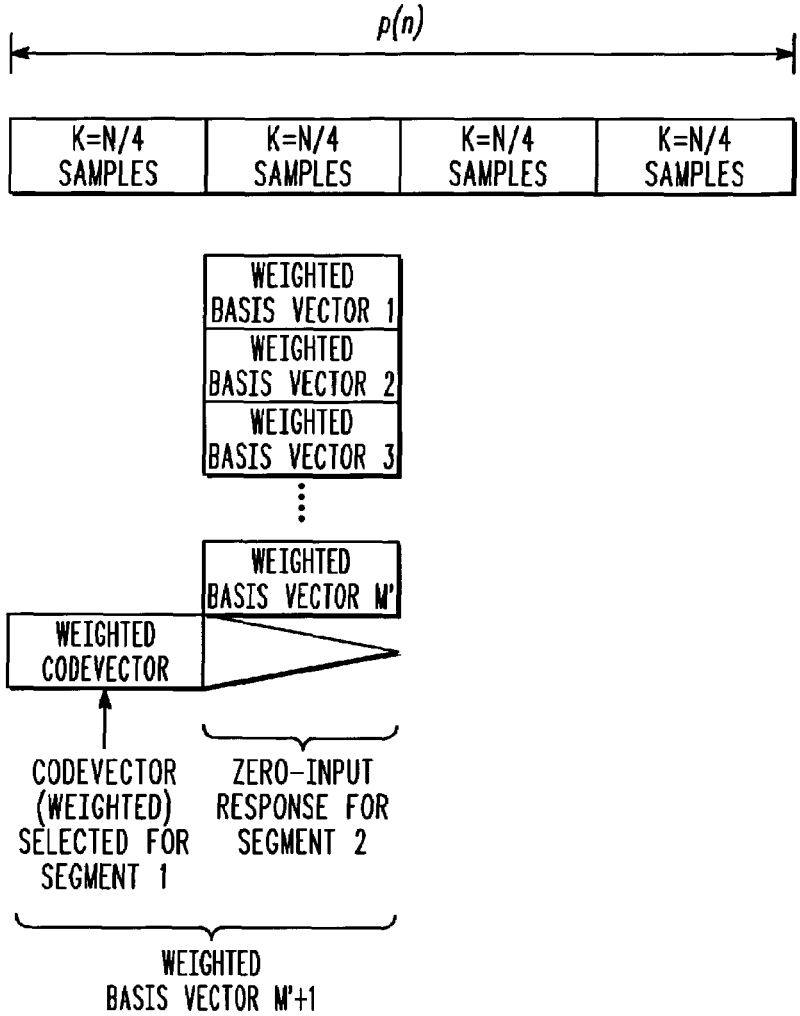
Figure 4D:
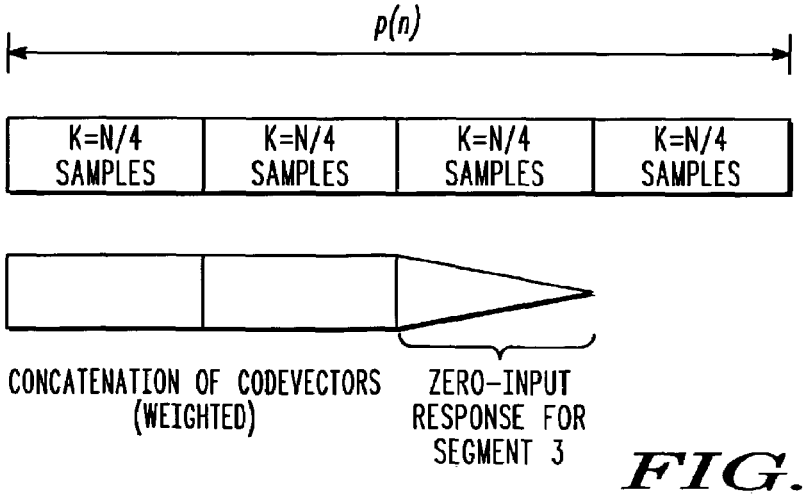
Figure 4E:
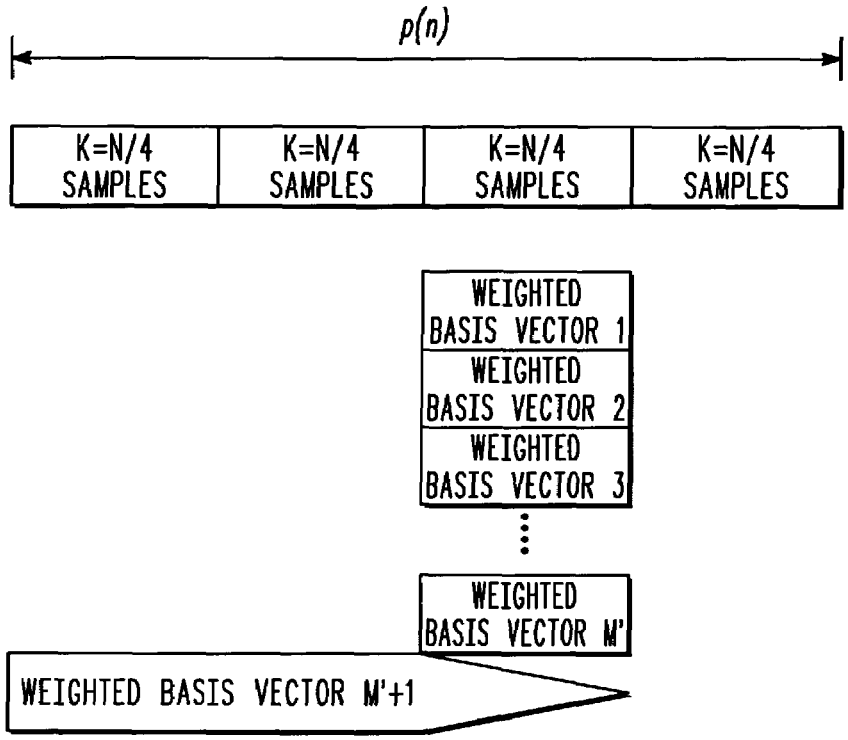
Figure 4F:
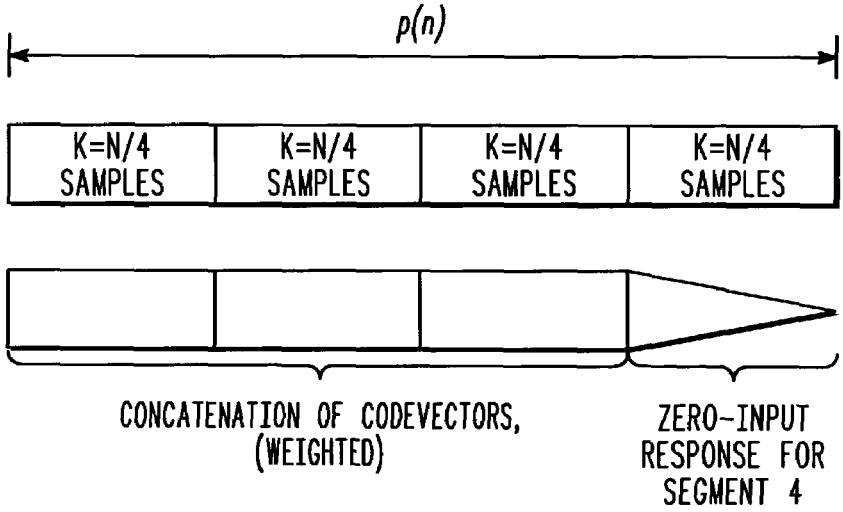
Figure 4G:
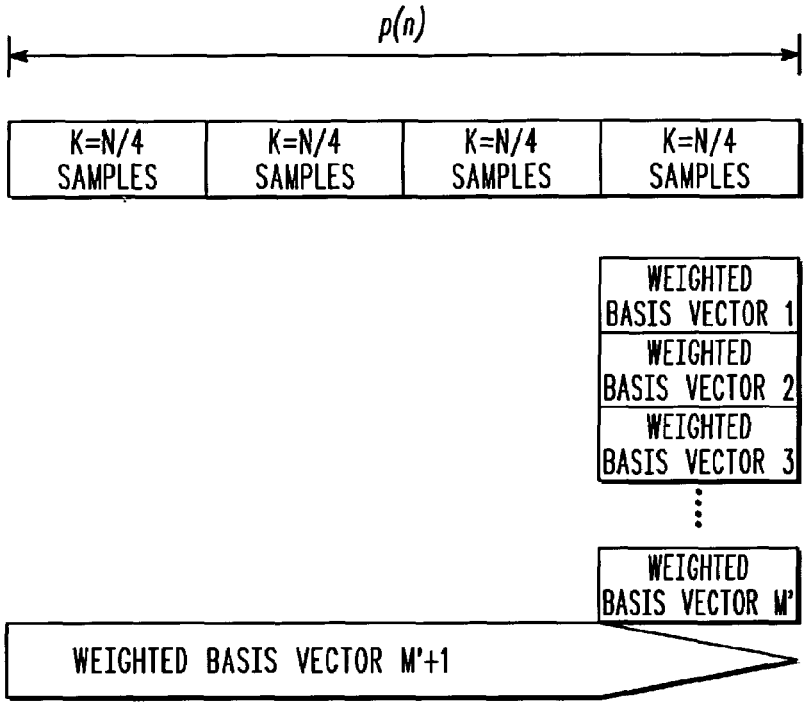
Figure 4H:
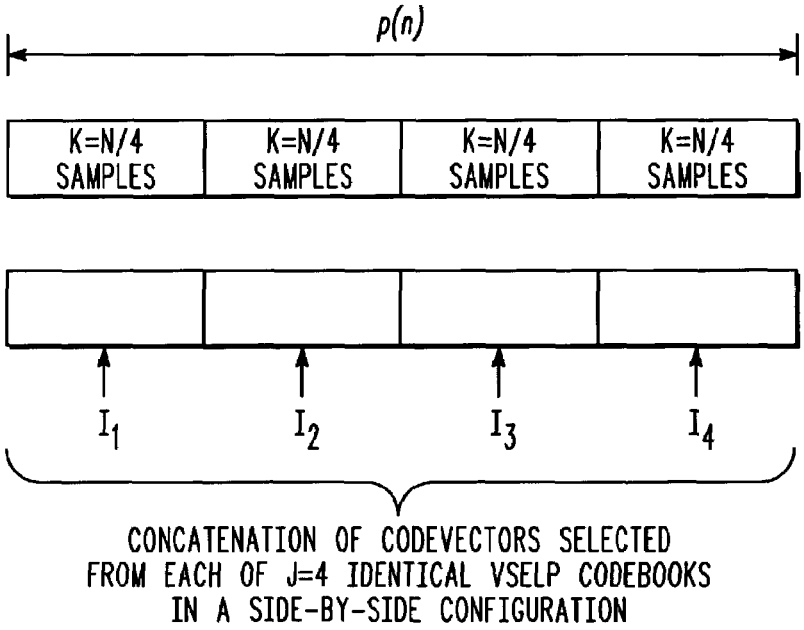

If the current segment is not the first segment, it is necessary to update the carry-along basis vector. A concatenation of codevectors or carry-along basis vector are formed as a concatenation of VSELP codevectors selected up to but not including the current segment. This updating entails constructing the unweighted VSELP codevector corresponding to the best codeword identified for the previous segment, and appending it onto the content of the memory location reserved to storing the carry-along-basis vector. Next, the convolution operation with h(n), the impulse response of the weighted synthesis filter is resumed, over the VSELP codevector selected at the previous segment, to obtain an updated filtered version of the carry-along basis vector. At this point, the filtered carry-along basis vector is defined up to (but not including) the beginning of the current segment. To extend it into the current segment, the zero input response of the carry-along basis vector is computed for the current segment. This is done by setting the sample values of the unfiltered carry-along basis vector to 0 for the interval of the current segment, and continuing the convolution operation of the unfiltered carry-along basis vector with h(n) into the current segment. Thus, the section of the filtered carry-along basis vector that lines up with the current segment, contains the zero input response of the carry-along basis vector to h(n). The process of constructing and weighing (by convolving with h(n)) of the carry-along basis vector is indicated in FIGS. 4B, 4D, and 4F, for the cases where the j, the index of the current segment, is 2, 3, and 4 respectively. The carry along-basis vector becomes $M'+1^{th}$ basis vector for the VSELP codebook search at the current segment, as shown in FIGS. 4C, 4E, and 4G, for the cases where the j is 2, 3, and 4 respectively. Note that the polarity of the carry-along basis vector may be allowed to change, or may be fixed for the M'+1 basis vector codebook search. If the polarity of the carry-along basis vector is allowed to change and is changed, the codewords for the codevectors that constitute the carry along basis vector are complemented. Once a VSELP codevector is selected for the current segment, it will be used at the next segment to replace the zero input response to h(n), by being actually convolved with h(n) as was already described above. The $(M'+1^{th})$ basis vector is employed so that the contribution to the minimization of the weighted MSE of the concatenation of codevectors selected at j−1 segments, is taken into account when searching the VSELP codebook at the j-th segment for a codevector that minimizes the weighted MSE over the first j*K samples of the subframe. Even though the codebook search for segments j>1 uses (M'+1) basis vectors at each segment, only M' bits are needed to specify the codeword corresponding to the selected codevector at each of the J segments. FIG. 4H shows the concatenation of the selected codevectors, where $I_1$, $I_2$, $I_3$, and $I_4$ are the corresponding codewords. This concatenation of selected codevectors over J segments becomes the selected excitation codevector for the subframe. The selected codewords $I_1$, $I_2$, $I_3$, and $I_4$, each defined by M' bits, may be applied to an output codeword generator that forms an M bit codeword I, which is the index of the selected excitation codevector from the excitation codebook, and is then transmitted to the decoder. Alternately, the output codeword generator may simply output codewords $I_1 \ldots I_4$. The decoder uses the transmitted index (or indices), which it received from the encoder, to generate the selected excitation codevector from the excitation codebook, which is identical to the excitation codebook used by the encoder. The extracted excitation codevector is then typically applied to the LTP filter and the STP filter to reconstruct the synthetic speech. Typically the gain (or scale factor) for excitation codevector I is quantized, as are the parameters defining the LTP filter and the STP filter. The indices of those quantized parameters are transmitted from the encoder to the decoder, in addition to the index I (or indices $I_1$, $I_2$, $I_3$, and $I_4$), and are used by the decoder to reconstruct the synthetic speech.

It should be appreciated that since the carry-along basis vector may be viewed simply as an additional basis vector, albeit an adaptively generated one, to supplement an M' bit VSELP codebook, the assumption that the weighted error due to each VSELP codevector being evaluated uses optimal value of the gain for that codevector is still valid. This means that although the waveform shape of the carry-along basis vector is fixed at a given segment, its amplitude is multiplied by the optimal value of the gain, corresponding to the VSELP codevector being evaluated. This optimal value of the gain is assumed to scale all M'+1 basis vectors, from which the current codevector under evaluation is derived. Note also that just like in the original VSELP codebook search, the weighted codevector need not be explicitly constructed to compute the weighted error corresponding to it, but the weighted error calculation is based on precomputed correlation items C and power terms G, which are updated recursively.

Using these techniques, the complexity of searching a 45 bit VSELP codebook (N=40, M=45, M'=9, J=5) was found to be approximately equivalent to searching a traditionally structured 10 bit VSELP codebook (N=40, M=10, J=1). This comparison was done by timing the execution speed of the function implementing the traditional VSELP codebook search and then timing the execution speech of the function implementing the search of the modified VSELP codebook structure as described above. 10000 function calls were done in each case, to minimize the start-up overhead. Random number generator was used to generate the target signal and the simulated weighted synthesis filter impulse response h(n).

The algorithm described above has been configured so as to reduce computational complexity. Other configurations, less computationally efficient but potentially more optimal (because less structured), are possible. For instance the side-by-side codebooks do not need to be identical nor specified by the same number of bits. If the codebooks are not identical, the denominator terms for the codebook search would need to be computed individually for each codebook, with no reuse from segment to segment. Another possible configuration, would start out with an M bit VSELP codebook, with each basis vector spanning the full subframe length. If M'<M, the VSELP codebook search may be conducted assuming M' bit VSELP codebook, i.e., using only the first M' basis vectors for the search. Once the best M' bit codevector is found, the M' basis vectors are used to construct the selected codevector, and that codevector may be viewed as a single basis vector. Thus the M' bit codevector becomes the first basis vector for the subsequent codebook search of the resulting M-M'+1 basis vector codebook. This search strategy can be extended to codebook search with more than two stages. Or a VSELP codebook structure can be defined, which combines some or all of the configurations described thus far.

Yet another embodiment of the invention would not require the initial carry-along basis vector to be constructed using the VSELP technique. Any type of an excitation codebook may be employed to generate a selected codevector, with that codevector becoming the $(M+1^{th})$ basis vector (or equivalently the carry-along basis vector) of a VSELP codebook defined by M' basis vectors, at the next segment or stage.

When the side-by-side codebook configuration is being used, the relative energy variation in the ideal excitation sequence among the J segments may be vector quantized to allow the codebook excitation to better track the energy variation in the target signal for the codebook search. This may be efficiently incorporated into the codebook search methodology outlined.

While specific embodiments of the present invention have been shown and described herein, further modifications and improvements may be made without departing from the invention in its broader aspects. For example, any type of basis vector may be used with the vector sum technique described herein. In the preferred embodiment, a VSELP codebook optimization procedure is used to generate a set of basis vectors, with the minimization of the weighted error energy being the optimization criterion. Moreover, different computations may be performed on the basis vectors to achieve the same goal of reducing the computational complexity of the codebook search procedure. All such modifications that retain the basic underlying principles disclosed and claimed herein are within the scope of this invention.

What is claimed is:

1. A codebook excited linear prediction (CELP) coding system comprising:

a first excitation codebook;

a first selector for selecting a codevector from the first excitation codebook;

a second excitation codebook comprising a VSELP codebook, with the codevector being selected from the first excitation codebook used as an additional VSELP basis vector for searching the second codebook;

a second selector for selecting a codevector from the second excitation codebook; and an output generator for providing at least one codeword that is a function of at least the first selected codevector and the second selected codevector while intentionally using a same gain value for each of the first and second selected codevector.

2. A coding system as recited in claim 1, wherein said first excitation codebook comprises a VSELP codebook.

3. A coding system as recited in claim 1, comprising an index generated from said first selector, said index corresponding to the selected codevector from said first codebook, wherein said output generator provides the codeword as a function at least of the first index.

4. A coding system as recited in claim 3, comprising a second index generated from said second selector, said second index corresponding to the selected codevector from said second codebook.

5. A coding system as recited in claim 1, comprising:

a third excitation codebook comprising a second VSELP codebook, with an additional VSELP basis vector at least dependent on a linear superposition of the codevector selected from the first excitation codebook and of the codevector selected from the second excitation codebook, said additional VSELP basis vector is provided for searching the third codebook;

a third selector for selecting a codevector from the third excitation codebook; and said output generator providing said at least one codeword as a function of the first selected codevector, the second selected codevector, and the third selected codevector.

6. A coding system as recited in claim 5, wherein said first selector selects the first codevector from the first codebook to generate an index for the selected codevector from the first codebook, said second selector selects the second codevector from the second codebook to generate an index for the selected codevector from the second codebook, and said third selector selects the third codevector from the third codebook to generate an index for the selected codevector from the third codebook; and said output generator provides at least one codeword as a function of the first index, the second index, and the third index.

7. A codebook excited linear prediction (CELP) coding system comprising:

a first excitation codebook;

a linear predictive filter responsive to an input signal desired to be modeled for identifying a codevector over predetermined intervals as a subset of the input signal;

a selector for identifying a preferred codevector, said selector defining an additional basis vector for a second excitation codebook as a function of at least the codevector identified from said first codebook wherein both the additional basis vector and a basis vector as corresponds to the first excitation codebook intentionally have a same gain value applied thereto;

a vector quantizer for synthetic excitation for modeling waveform signal components corresponding to the input signal desired to be modeled.

8. A coding system as recited in claim 7, comprising a long term predictor responsive to at least the input signal.

9. A coding system as recited in claim 7, wherein the codevector identified over the predetermined intervals is derived from said first codebook for use by said linear predictive filter for modeling the waveform signal components over the predetermined intervals.

10. A coding system as recited in claim 9, further comprising a second codebook comprising a VSELP codebook that includes said additional basis vector for identifying a codevector over a second predetermined interval corresponding to the input signal desired to be modeled by concatenation with signals generated from the selected codevector from the first codebook and the codevectors from said second codebook.

11. A coding system as recited in claim 10, wherein the additional basis vector for said second codebook comprises a carry-along basis vector.

12. A coding system as recited in claim 11, wherein the input signal desired to be modeled is divided into J predetermined intervals each of which correspond to codebooks each comprising M' basis vectors.

13. A coding system as recited in claim 12, wherein the M' basis vectors span K samples, wherein K is equal to the subframe length N of the input signal desired to be modeled.

14. A coding system as recited in claim 12, wherein J codebooks each comprising M' bit basis vectors over the predetermined intervals each provide a subset of the input signal desired to be modeled.

15. A coding system as recited in claim 14, wherein each of said J codebooks correspond to side-by-side segments of the modeled input signal to reduce the complexity of the codebook search.

16. A coding system as recited in claim 15, wherein said selector includes a generator that precomputes energy terms G for identical side-by-side segments of the modeled input signal.

17. A coding system as recited in claim 14, wherein each of the J codebooks contain identical M' basis vectors.

18. A method of generating codevectors from an excitation codebook for synthetic excitation to model waveform signal components, comprising:

inputting a first codebook as a set of M' basis vectors;

generating at least one selector codeword;

modeling a waveform signal component from said codebook vectors by performing linear transformations on said M' basis vectors;

inputting a carry-along basis vector based on at least the first selector codeword for a second codebook, wherein both the carry-along basis vector and the first selector codeword have a same gain value intentionally applied thereto; and modeling an additional waveform signal component by performing linear transformations on said second codebook.

19. A method for synthetic excitation of modeled waveform signal components as recited in claim 18, wherein the selector for the first codebook identifies a codevector for a predetermined interval as a subset of an input signal modeled waveform component over the predetermined interval.

20. A method for synthetic excitation of modeled waveform signal components as recited in claim 19, comprising identifying a codevector over a second predetermined interval from the second codebook corresponding to the modeled waveform for concatenation with signals generated from the codevector of the first codebook.

21. A method for synthetic excitation of modeled waveform signal components as recited in claim 20, wherein the input signal desired to be modeled is divided into J predetermined intervals each of which corresponds to codebooks each comprising M' basis vectors.

22. A method for synthetic excitation of modeled waveform signal components as recited in claim 21, wherein the M' basis vectors span K samples equal to the subframe length N of the modeled signal.

23. A method for synthetic excitation of modeled waveform signal components as recited in claim 22, wherein J codebooks each comprise M' basis vectors over the predetermined intervals each providing a subset of the input signal desired to be modeled.

24. A method for synthetic excitation of modeled waveform signal components as recited in claim 23, wherein each of the J codebooks are provided as identical codebooks each containing M' basis vectors.

* * * * *

UNITED STATES PATENT AND TRADEMARK OFFICE

CERTIFICATE OF CORRECTION

PATENT NO. : 7,337,110 B2
APPLICATION NO. : 10/227725
DATED : February 26, 2008
INVENTOR(S) : Mark A. Jasiuk It is certified that error appears in the above-identified patent and that said Letters Patent is hereby corrected as shown below:

IN THE SPECIFICATION

In Column 1, Line 65, delete "EEEE" and insert -- IEEE --, therefor.

In Column 8, Line 60, delete "$E_1$" and insert -- $E_i$ --, therefor.

In Column 11, Line 27, delete "$2_{M-1}$," and insert -- $2^{M-1}$, --, therefor.

Signed and Sealed this

Thirtieth Day of June, 2009

JOHN DOLL
*Acting Director of the United States Patent and Trademark Office*